US009534466B2

(12) United States Patent
Pathak et al.

(10) Patent No.: US 9,534,466 B2
(45) Date of Patent: Jan. 3, 2017

(54) CAP SYSTEM FOR SUBSEA EQUIPMENT

(75) Inventors: Parth D. Pathak, Houston, TX (US); Harrison J. Li, Houston, TX (US); John T. Bogard, Houston, TX (US)

(73) Assignee: OneSubsea IP UK Limited, London (GB)

( * ) Notice: Subject to any disclaimer, the term of this patent is extended or adjusted under 35 U.S.C. 154(b) by 862 days.

(21) Appl. No.: 13/601,700

(22) Filed: Aug. 31, 2012

(65) Prior Publication Data

US 2014/0060849 A1 Mar. 6, 2014

(51) Int. Cl.
*E21B 33/035* (2006.01)
*E21B 33/037* (2006.01)
*E21B 33/038* (2006.01)

(52) U.S. Cl.
CPC ..... *E21B 33/035* (2013.01); *E21B 33/037* (2013.01); *E21B 33/038* (2013.01)

(58) Field of Classification Search
CPC .... E21B 33/035; E21B 33/037; E21B 33/038; E21B 33/043
USPC ... 166/75.13, 92.1, 97.1, 368, 356, 360, 351
See application file for complete search history.

(56) References Cited

U.S. PATENT DOCUMENTS 5,107,931 A * 4/1992 Valka et al. ..... 166/342
6,474,416 B2 * 11/2002 Beall et al. ..... 166/343
6,776,230 B2 * 8/2004 Collie ..... E21B 43/128 166/337
6,817,417 B2 * 11/2004 Blair et al. ..... 166/335
7,677,319 B2 3/2010 Baskett
8,087,465 B2 1/2012 Huang et al.
2002/0011336 A1 1/2002 Baskett et al.
2002/0100592 A1 * 8/2002 Garrett et al. ..... 166/378
2002/0185279 A1 * 12/2002 Blair et al. ..... 166/335
2004/0040702 A1 * 3/2004 Hergarden et al. ..... 166/97.1
2004/0262010 A1 * 12/2004 Milberger ..... E21B 33/043 166/368
2008/0190621 A1 * 8/2008 Huang et al. ..... 166/339
2009/0025939 A1 * 1/2009 Wenham et al. ..... 166/368
2009/0266551 A1 * 10/2009 Cuiper et al. ..... 166/338
2011/0048726 A1 3/2011 Aarnes et al.

FOREIGN PATENT DOCUMENTS

WO 2008100570 A1 8/2008
WO 2009134141 A1 11/2009

OTHER PUBLICATIONS

International Search Report and Written Opinion dated Nov. 13, 2013 for PCT Application No. PCT/US2013/057206 filed Aug. 29, 2013.

* cited by examiner

*Primary Examiner* — James G Sayre
(74) *Attorney, Agent, or Firm* — Chamberlain Hrdlicka

(57) ABSTRACT

A cap system for subsea equipment that can be employed on various subsea equipment including but not limited to a vertical monobore tree, a horizontal tree, a wellhead and a tubing head spool. The cap system includes a cap assembly that has the flexibility of installation and retrieval for open water as well as a through a riser with a running tool. The cap assembly also does not require any orientation during installation. The cap system includes a debris cap assembly installable in engagement with the cap assembly. The debris cap assembly interfacing with the cap assembly provides the ability to inject and bleed fluids through a main bore and an annulus bore of the subsea tree independently and without removal of the debris cap assembly and cap assembly.

21 Claims, 8 Drawing Sheets

CAP SYSTEM FOR SUBSEA EQUIPMENT

BACKGROUND

Drilling and producing offshore oil and gas wells includes the use of offshore facilities for the exploitation of undersea petroleum and natural gas deposits. A typical subsea system for drilling and producing offshore oil and gas can include the installation of a cap that commences when an operation, such as drilling a subsea well, is suspended or terminated.

Normally, a well is drilled for exploration or development, but once the well has been drilled and the rig is ready to move off location or move to another well, the blow-out preventer (BOP) is disconnected from the wellhead. The seal pocket on the wellhead would now be exposed and vulnerable to falling foreign objects. Typically, a subsea well can cost several millions of dollars to drill. Thus, leaving the wellhead exposed to damage from falling objects or other intruders could result in a loss of severe financial damage, as well as the loss of seal integrity and thereby render the wellhead useless.

When a wellsite is abandoned or temporarily suspended, it is desirable to protect the wellhead. During the installation of a subsea flow line, the drilling of a subsea well, the drilling of a mudline suspension well or the installation of a subsea tree, it may be necessary to suspend the operation due to inclement weather or requirement of additional equipment. When the operations have been suspended or completed, the end or top of the pipe or equipment has a seal area or a profile that needs to be protected from foreign objects, damage and/or marine growth. These seals, surfaces and profiles have varied outer and inner diameters, shapes and lengths. They also may contain seal pockets or integral components that need to be protected from corrosion and/or marine growth.

Thus, because of the potential for enormous loss of time and money and the need for protection on multiple structure profiles, it is desirable to have a cap for a subsea structure. For example, a tree cap can serve as a secondary pressure barrier on a subsea tree. There are a number of issues that could arise if these structures are not protected.

Also, hydrates can form beneath the tree caps, and methanol injection is required to dissolve these hydrates. Where water is present in gas being produced from a subterranean formation, the problem of gas hydrate formation exists. Often gas produced from a subterranean formation is saturated with water, thus that formation of gas hydrates poses a very significant problem. Hydrates are a solid, complex compound of hydrocarbons and water. Once a hydrate blockage occurs, pressure builds behind the hydrate blockage, which causes additional hydrates to form as a result of the increased pressure. Methanol can be injected to help further dissolve and prevent hydrate formation. Other chemicals can be injected into the flow lines.

Additionally, one of the most prominent characteristics of currently available protective coverings for subsea structures is that the size and shape of the covering must be closely matched to the size and shape of the subsea structure to enable the covering to mate with and latch to the structure. This design constraint means that there must be different coverings for different applications and the mating/latching requirements mean that the covering is much more expensive to manufacture and maintain.

In general, the approach of the prior art has been to focus on a particular aspect of protection that is very structure-dependent, costly to manufacture, and complex to operate. It would, therefore, be a significant advancement in the art and it is an object of the present invention to provide an improved cap that is simple to manufacture, install and remove. In addition, as the offshore oil industry moves to deeper and deeper depths, the time it takes to lower or retrieve the tree cap with drill pipe will cost a well operator thousands of dollars in rig time alone. Thus, it is desirable to have a tree caps and debris caps with flexibility for installation, retrieval, and operation.

BRIEF DESCRIPTION OF THE DRAWINGS

A better understanding of the various disclosed system and method embodiments can be obtained when the following detailed description is considered in conjunction with the drawings, in which.

DETAILED DESCRIPTION

Figure 1:
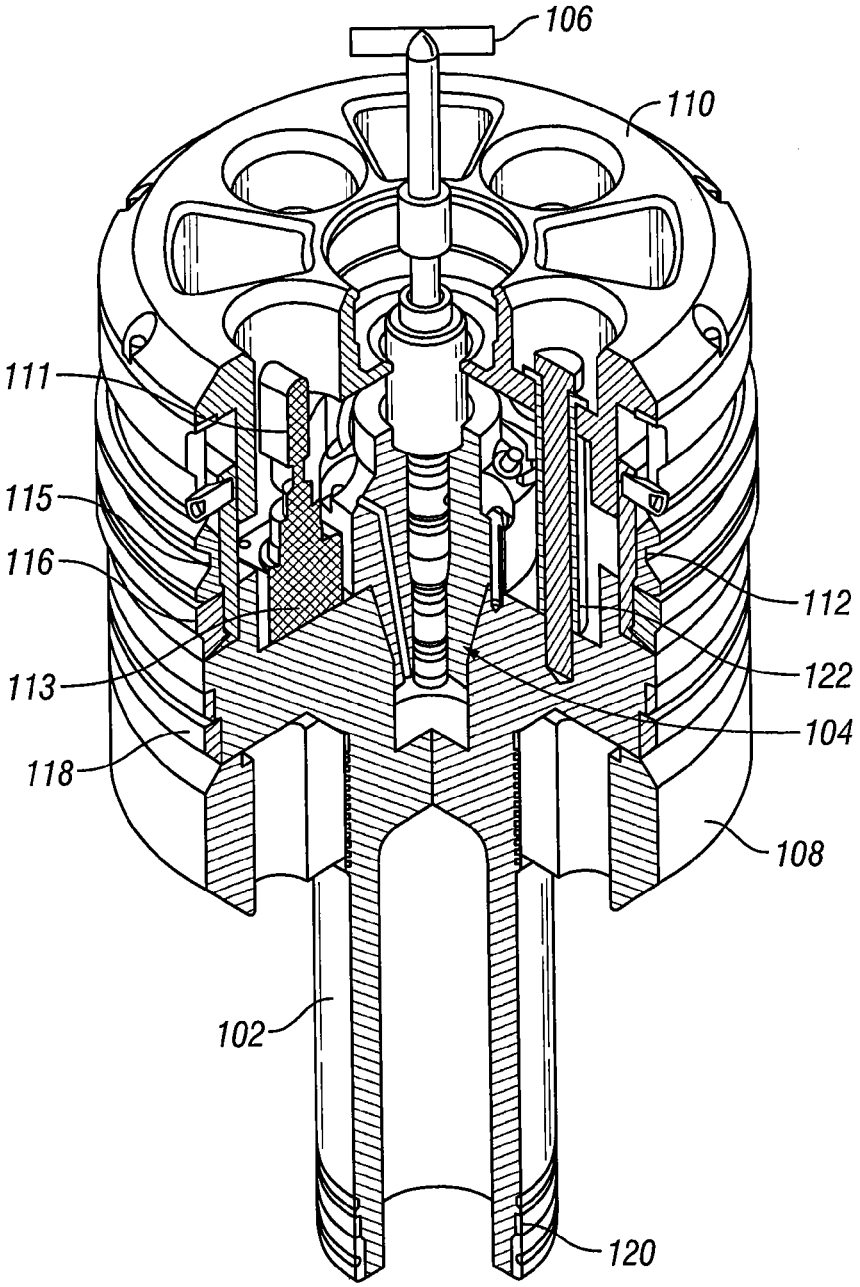
FIG. 1 is an illustrative cap assembly that is part of a cap system for subsea equipment in accordance with various embodiments.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Disclosed herein is a cap system for subsea equipment, including a vertical tree, a horizontal spool tree, a wellhead, and a tubing head spool; which can be installed and retrieved using a running tool either through a riser or open water. Also disclosed is a cap system for subsea equipment, including a vertical tree, a horizontal spool tree, a wellhead, and a tubing head spool that includes a tree cap-debris cap assembly including a tree cap assembly and a debris cap assembly engageable with the tree cap. Although the most embodiments will include the discussion of the installation of the cap assembly into a tree, it should be noted that the cap assembly can be installed and used in any subsea equipment.

FIG. 1 shows an embodiment of the cap assembly that includes a cap body 102 including a valve block 113, a hot stab receptacle 104, a split lock ring 112, an actuator plate assembly 110, and an actuator guide ring 115. FIGS. 1-7 show the cap assembly installed as a tree cap in a production tree for example purposes only. However, the cap assembly may be used as a cap for any type of subsea equipment. The cap assembly also includes paddles 111 (only one shown) that may be manipulated by an ROV and interact with valves in the tree as discussed further below. The actuator plate assembly 110 actuates the split lock ring 112 with guidance from the actuator plate so that the cap assembly locks inside a subsea tree. A dummy hot stab insert 106 may be used as a place holder for the hot stab 512 (shown in FIG. 5) from the debris cap assembly before connection as discussed further below. The hot stab receptacle 104 is located at the center of the tree cap body, and is used for accepting the debris cap assembly (discussed below).

Figure 4:
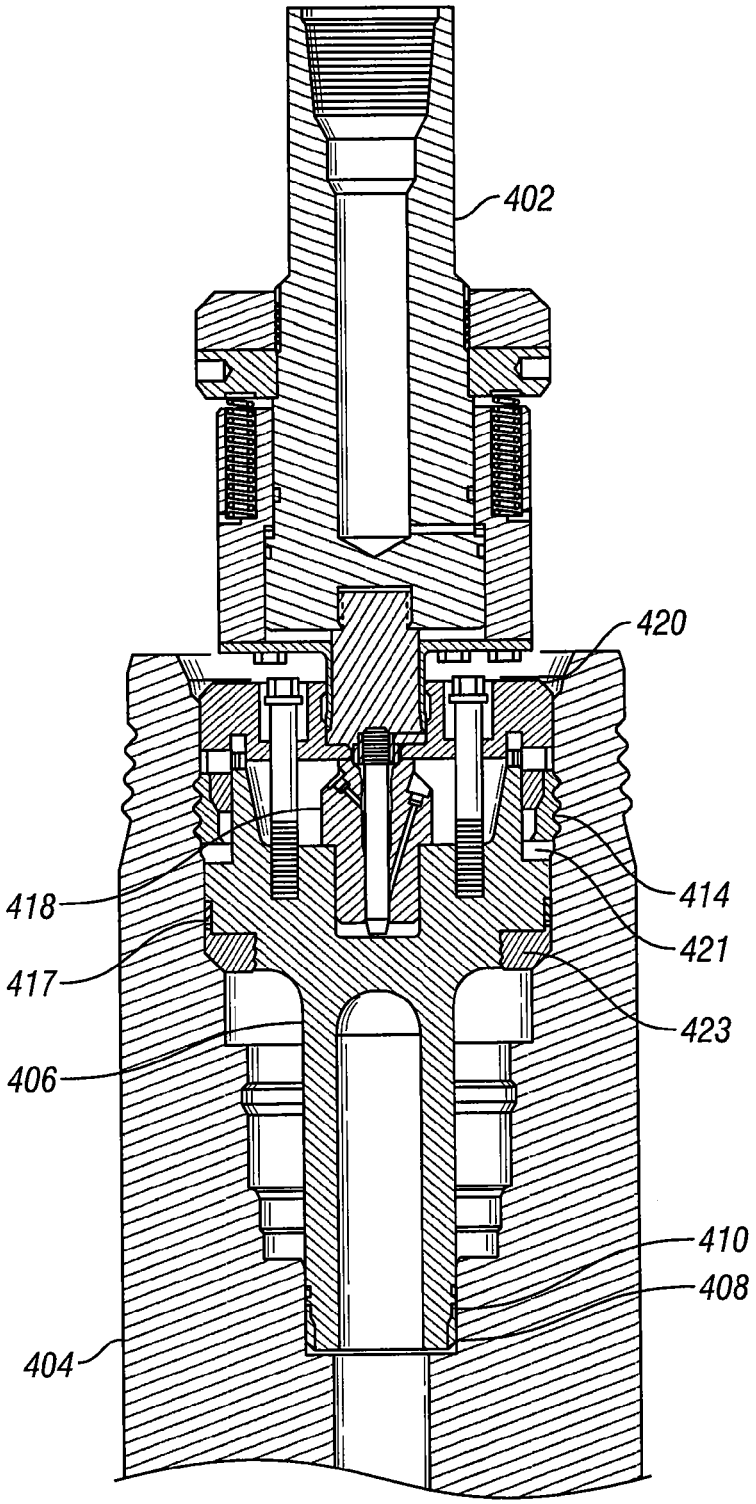
FIG. 4 is an illustrative, 2-D view of the cap assembly installation through the riser.

The cap assembly is installed and guided down into the bore of the subsea tree and locked in place without needing to adjust the connection of the running tool and cap assembly as explained further below. The running tool has to only push on the actuator plate assembly to install the cap assembly. To help guide the cap assembly into the bore of the subsea tree, the cap assembly includes a guide bushing 108. After initial guidance down into the bore of the tree, the cap assembly lands on an internal shoulder in the bore of the tree. Further application of force on the actuator plate assembly 110 actuates the split lock ring 112 with guidance from the actuator plate so that the cap assembly locks in place in the subsea tree. The actuator plate is thus actuated by a running tool pushing the actuator plate downward. Friction and reaction forces and shear pin cartridges engaged when the split lock ring 112 is actuated maintain the actuator plate in the locked position until the cap assembly is purposefully removed from the subsea tree. Bearing shoulder 116 is a high strength component to withstand the loads imparted due to high pressure from below the cap assembly. As shown in FIG. 4, when installed, the annulus bore of the subsea tree is sealed via a seal 118, and the main bore is sealed via a seal and a backup seal 120, thus isolating the fluids in the annulus between the tubing and the casing from the fluids in the tubing.

To remove the cap assembly, the running tool pulls on the actuator plate. The cap body 102 can also be removed by pulling on lift screws 122 via the actuator plate 110. The body 102 of the tree cap can be of any shape that covers the open upper end of the subsea structure. The shape of the preferred embodiment, as shown in FIG. 1, is circular. This is meant by way of example and is not meant to limit the scope of the invention.

Figure 2:
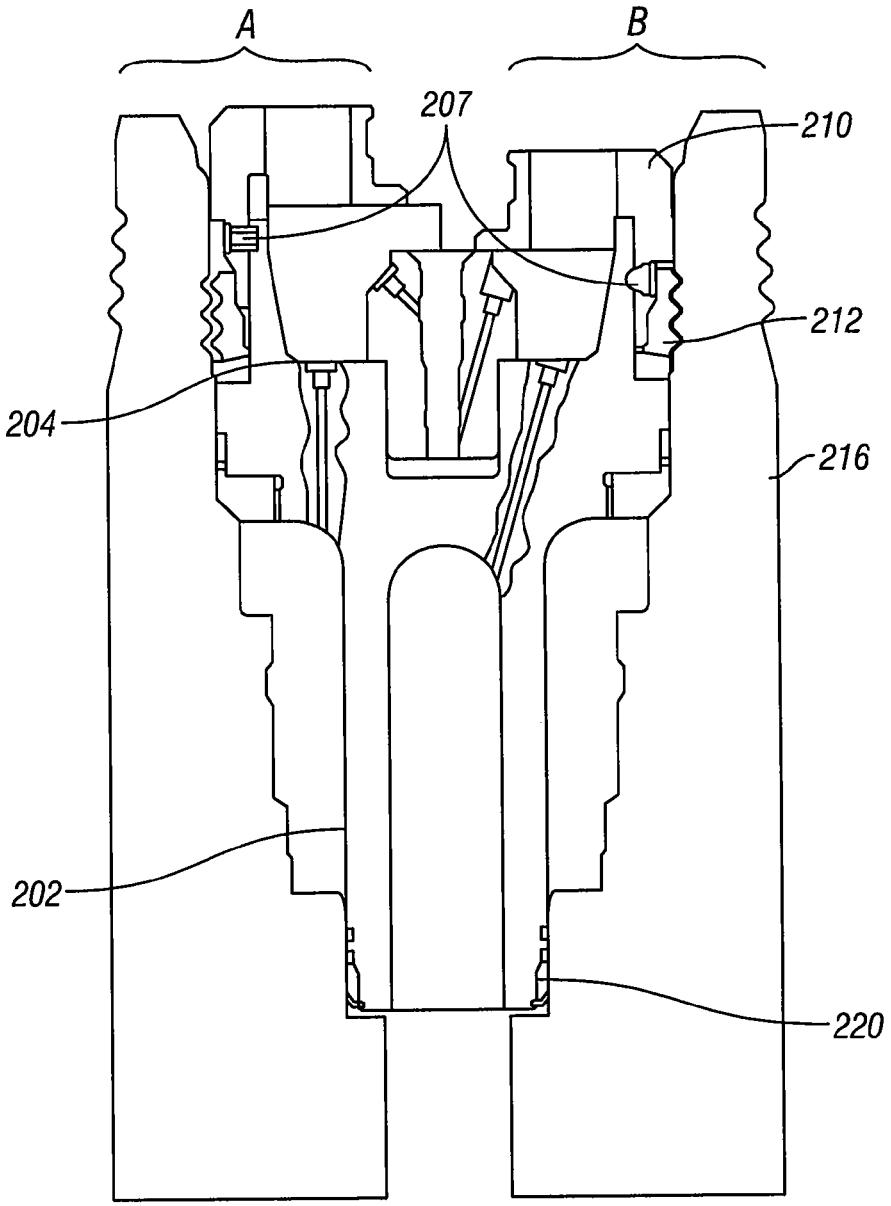
FIG. 2 is the cap assembly installed inside a subsea tree.

FIG. 2 shows another illustrative, 2-dimension view of the cap assembly that includes a cap body 202, a hot stab receptacle 204, a split lock ring 212, and an actuator plate 210. The actuator plate 210 actuates the split lock ring 212 with guidance from the actuator plate so that the cap assembly locks inside a subsea tree 216. The left area A of FIG. 2 shows the cap assembly landed in the tree, before it is locked into the subsea tree 216. The right side B of FIG. 2 shows the cap assembly after it is landed and locked into the subsea tree 216. When locked, the shear pins 207 shear and the split lock ring 212 is expanded and locked into the subsea tree 216. The hot stab receptacle 204 is located at the center of the cap body 202, and is used for accepting the debris cap assembly as described below.

For installation, the cap assembly engaged with the running tool can be lowered into the sea via drillpipe, wirelines, or cables with ROV assistance. For open water installation, a ROV can apply force or torque which results in pushing the actuator plate to install the cap assembly into the tree. For through riser installation, the running tool connected to drill pipe is used to push on the actuator plate to install the cap assembly into the tree.

Figure 3:
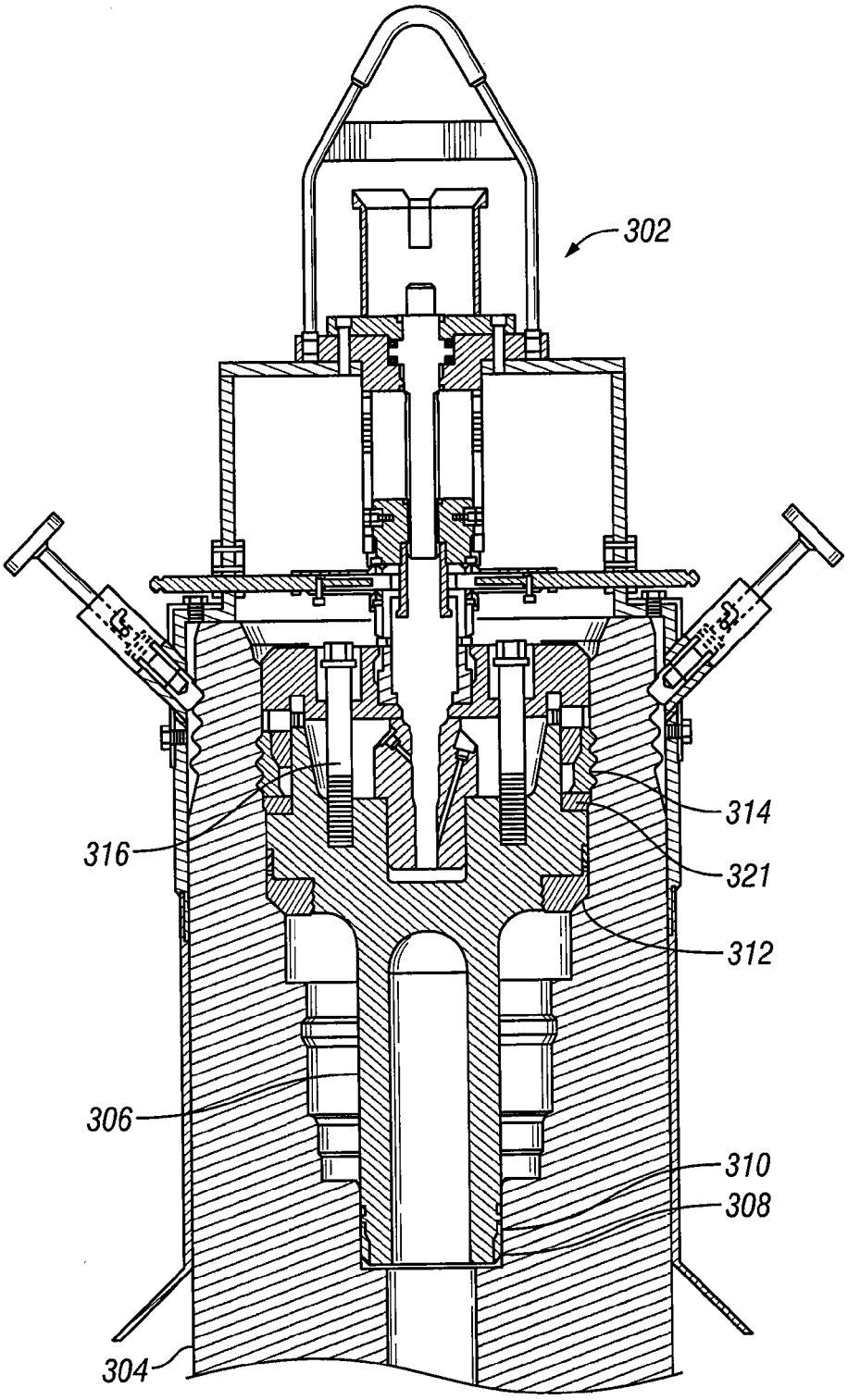
FIG. 3 is an illustrative, 2-D view of the cap assembly installation via an ROV operated, open water running tool.

The cap assembly can be installed, connected, and retrieved through open water via the ROV operable running tool, as shown in FIG. 3. FIG. 3 is a schematic of the cap assembly being installed with an ROV operable running tool 302. FIG. 3 also illustrates another embodiment of the cap assembly's connection with the tree 304, which includes the cap body 306, the main bore seals 308, annulus bore seal 310, landing and guiding shoulder 312, bearing shoulder 321, split lock ring 314, and lift screw 316. As another benefit, the cap assembly does not require any orientation during installation. In other words, during installation of the cap assembly, there is no key or groove to locate. There is also no need for rotation during installation. Installation simply requires lowering the cap assembly and pushing down on top of the cap assembly.

FIG. 4 similarly depicts installation of the cap assembly in another embodiment. FIG. 4 is an illustrative, 2-dimensional view of the cap assembly being installed through the riser with a running tool 402 that can be attached to the drill pipe (pulling and jarring tools). The cap assembly can be installed, connected, and retrieved through the riser with the running tool 402. As another benefit, the cap assembly does not require any orientation during installation onto the subsea tree 404. The cap assembly also includes a split lock ring 414 assembled with the cap body 406, a seal 410 around the cap body 406, a seal and a back-up seal 408 coupled to the lower elongated stab sub of the cap body 406, and a hot stab receptacle insert 418 located in the cap body 406. The split lock ring 414 locks onto the subsea tree 404 as a result of force being applied to the top of the actuator plate 420. The seal 410 is the primary seal and the backup seal 408 is the secondary seal for main bore on the tree cap for a tree. The seal 417 is the primary seal for the annulus bore and tertiary seal for the main bore of a tree. The bearing shoulder 421 and the landing shoulder 423 for the cap assembly is also shown in FIG. 4. Furthermore, the hot stab receptacle insert 418 is used to engage the debris cap assembly as described below.

Figure 5:
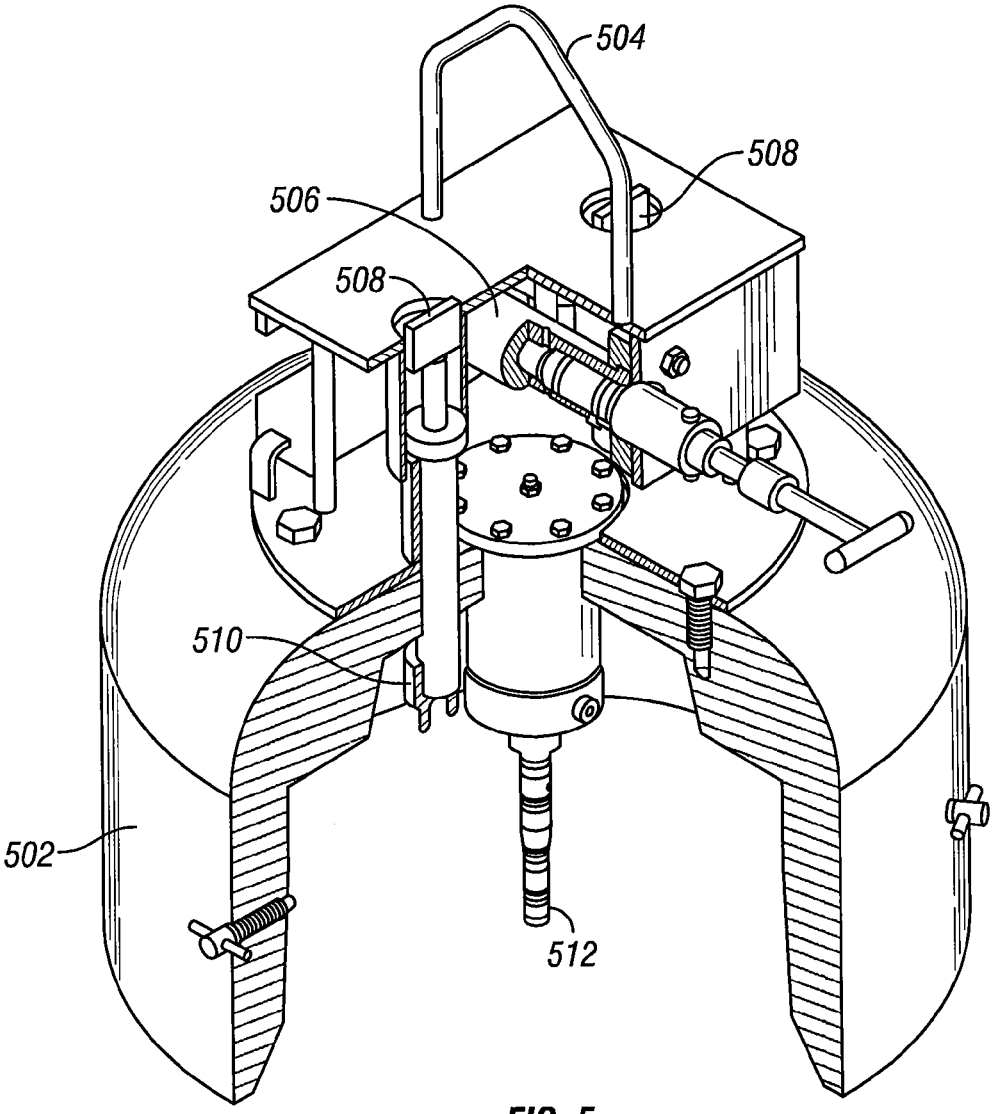
FIG. 5 is an illustrative debris cap assembly that is part of the cap system for subsea equipment in accordance with various embodiments.

FIG. 5 is an illustrative view of a debris cap assembly for use with the cap assembly. The debris cap assembly interfaces with the cap assembly to protect the cap assembly from debris and also to allow fluid injection (or bleeding) without removal of the external debris cap assembly. The debris cap assembly includes a debris cap body 502 which can be made for example from a buoyant material, a lift handle 504, an ROV hot stab 506, ROV paddles 508, valve paddle manipulators 510 (only one shown), and a hot stab male profile insert 512 for engaging with the cap assembly. The lift handle 504 is used to lift and transport the debris cap with the ROV itself. The handle 504 can be attached anywhere on the debris cap body 502 that allows an ROV or a diver or a cable to manipulate the debris cap body 502. The handle 504 in the preferred embodiment is shown attached to the top of the debris cap body 502. This is meant by way of example and is not meant to limit the scope of the invention.

Figure 6:
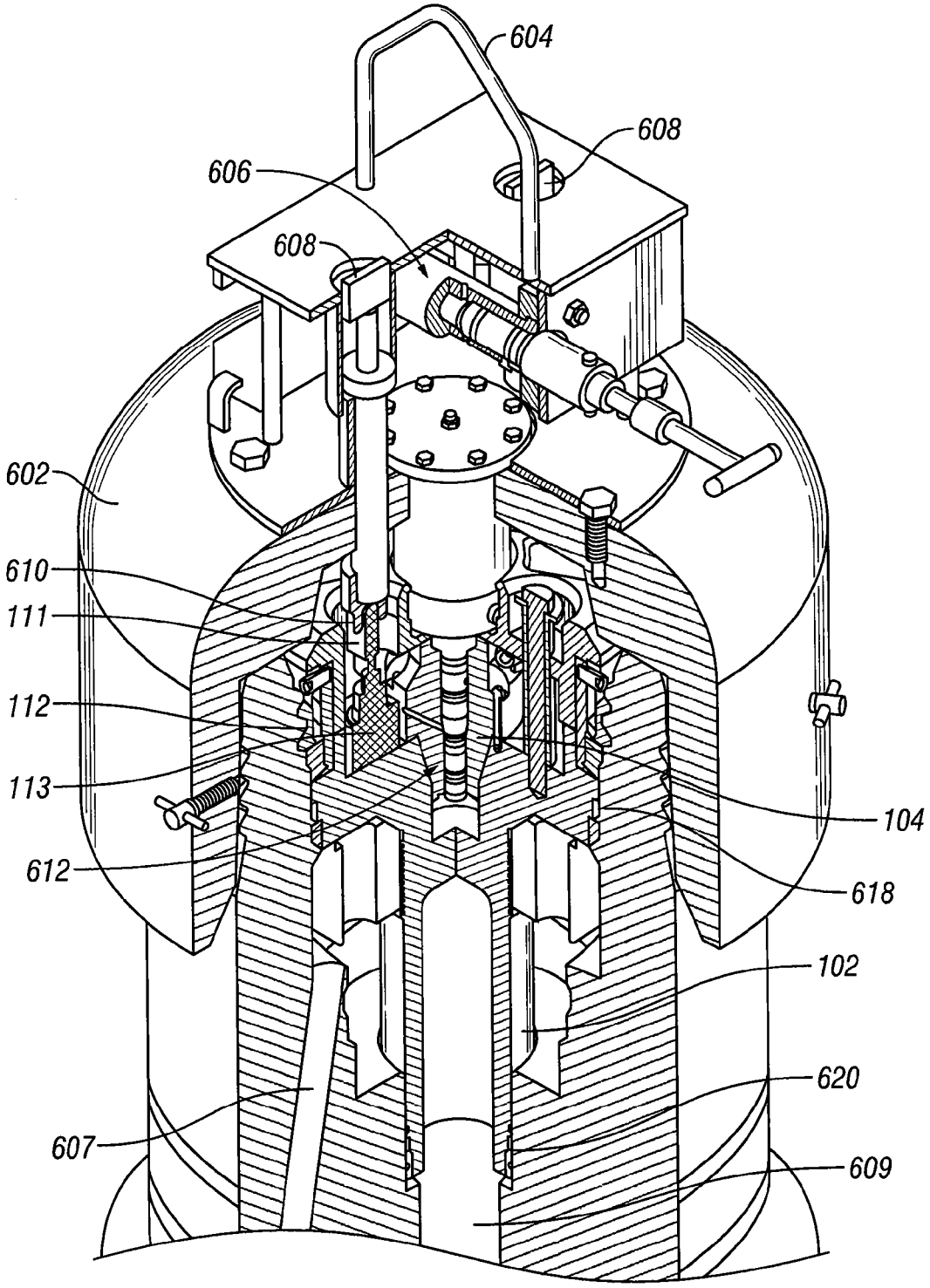
FIG. 6 is illustrative view of the system for subsea equipment installed on the top of a tree or tubing head spool.

As shown in FIG. 6, the debris cap body assembly is designed to engage and interact with the cap assembly. The debris cap assembly engages with the cap assembly through the hot stab male insert 612 that enters the hot stab receptacle 104 after removal of the dummy hot stab 106 from the cap assembly. The ROV hot stab 606 is used to bleed or inject fluid.

The ROV paddles 608 of the debris cap assembly may then be used by the ROV to open and close valves (710*a* and 710*b* discussed below) located in the cap assembly. The ROV paddles 608 have handles that interact with paddles 111 that are in the needle valve block 113 of the cap assembly. The ROV paddles 608 can also serve as a visual indication to an ROV operator or diver of whether or not the valves in the cap assembly are open or closed. The valves in the cap assembly (710*a* and 710*b* discussed below) are controlled by the valve paddle manipulator 710. As described further below, fluid, such as chemicals to dissolve hydrates formed beneath the cap assembly or other main bore or annulus bore fluids, are injected or bled through an ROV hot stab 706. Fluid lines from an ROV may be used to supply the fluid for injection through the debris cap assembly.

Figure 7:
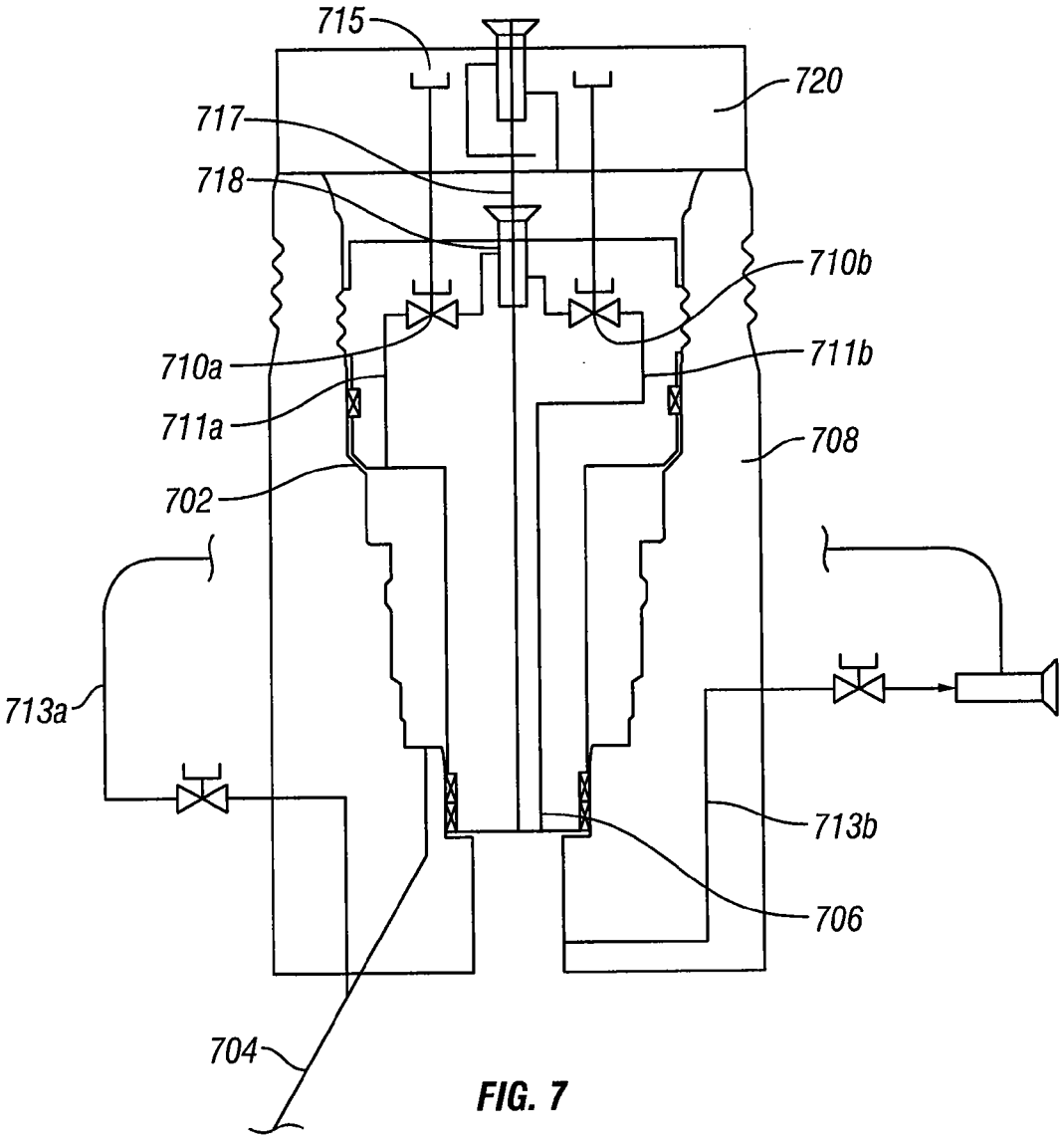
FIG. 7 is an illustrative view of flowlines for injection inside the cap assembly.

FIG. 7 shows an illustrative piping schematic that shows the paths of fluid injections through the debris cap assembly and the cap body 702 to the annulus bore 704 and main bore 706 of the subsea tree 708. FIG. 7 shows the debris cap body 720 installed on the cap assembly and the hot stab insert 717 of the debris cap assembly connected with the hot stab receptacle 718 of the cap assembly. Cap valves 710*a* and 710*b* provide control over the flowlines 711*a* and 711*b* leading to the annulus bore 704 and production bore 706 respectively. The annulus bore 704 and the production bore 706 can also be accessed through valves located on the subsea tree 708 separately and independently through flowlines 713*a* and 713*b*.

To inject (or bleed) fluids through the cap system for subsea equipment, an ROV stabs into the ROV hot stab 706 of the debris cap assembly. The ROV is then used to manipulate the ROV paddles 715 to open or close the cap valves 710*a* and 710*b*. Both cap valves 710*a* and 710*b* may be placed in the open or closed position at the same time or one valve may be opened while the other is closed. Which cap valve to open depends on whether it is desired to establish fluid communication with the tubing annulus or the main bore itself. Once fluid communication is established using the ROV, fluids may be injected or bled from either the annulus or the main bore itself through the debris cap assembly without removal of the debris cap assembly or the cap assembly.

Figure 8:
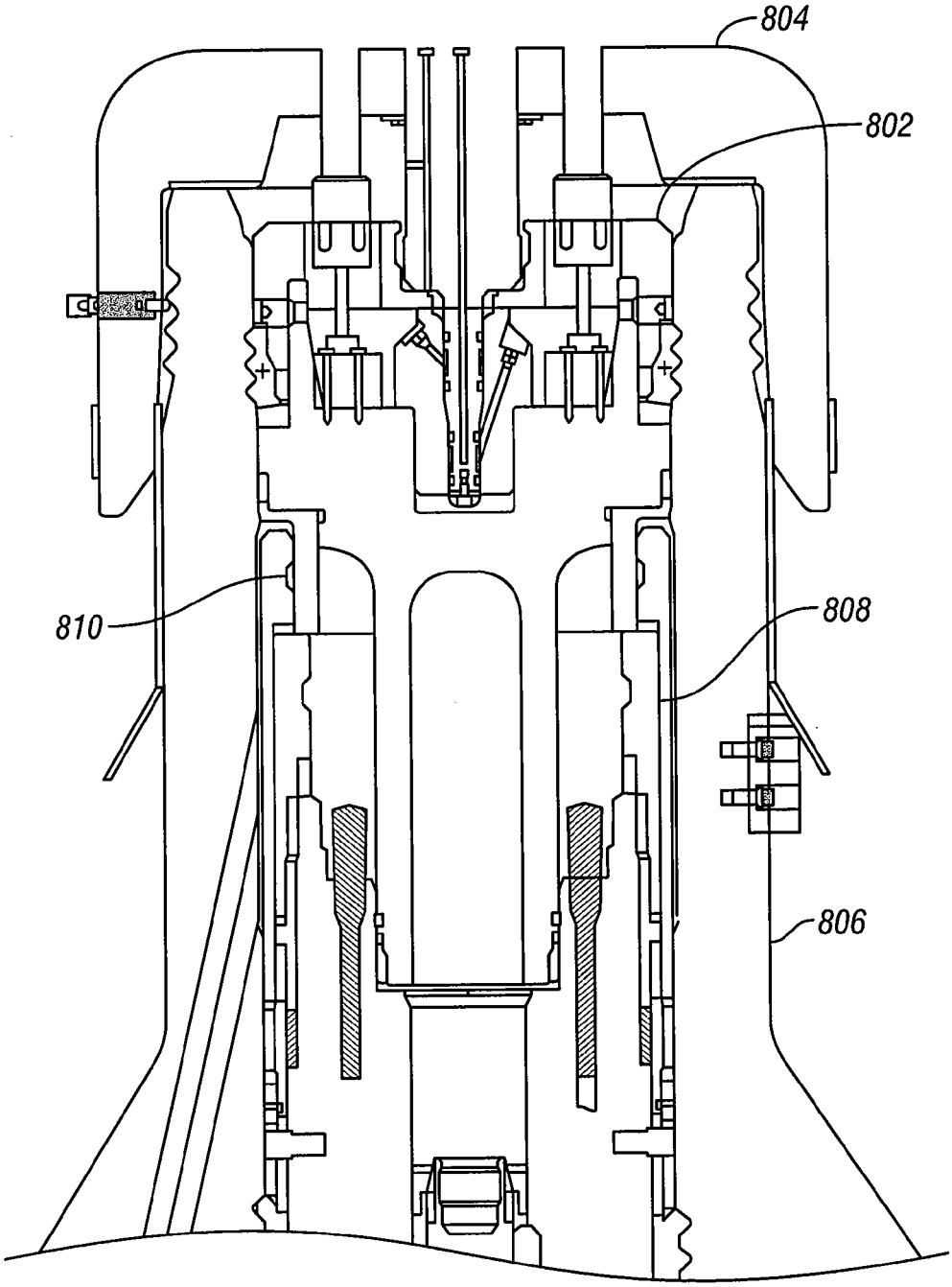
FIG. 8 is an illustrative view of the system for subsea equipment installed and landed in other subsea equipment.

FIG. 8 illustrates an embodiment where the cap assembly 802 and the debris cap assembly 804 are both installed and landed in other subsea equipment 806. The other subsea equipment 806 may include any type of subsea equipment, such as a tubing head spool or a wellhead, or any other equipment with a bore for capping. In the case of a tubing head spool, the cap assembly 802 and the debris cap assembly 804 can be landed above a tubing hanger 808 and within the landing ring 810, as shown.

There are multiple advantages to the presented invention. At least some of the advantages include flexibility in installation and retrieval. As discussed above, the assembly has the ability to be installed and retrieved open water by a mechanical ROV running tool. As another viable option, the cap assembly may also be installed through a riser using a running tool. Another feature of the invention is that the cap assembly may be removed from its storage position and installed openwater on the subsea equipment with ROV assistance. Further, the cap assembly does not require any orientation during installation. The assembly can also provide the ability to inject and bleed fluids through the main and annulus bores independently and without removal of the debris cap assembly.

Other embodiments of the present invention can include alternative variations. These and other variations and modifications will become apparent to those skilled in the art once the above disclosure is fully appreciated. It is intended that the following claims be interpreted to embrace all such variations and modifications.

What is claimed is:

1. A cap system for subsea equipment comprising an annulus bore, including a cap assembly installable using a running tool either through a riser or open water, the cap assembly comprising:
   - a main body portion comprising a valve operable to control fluid communication through the main body portion and with the annulus bore of the equipment;
   - an actuator plate assembly movable relative to the main body and comprising a profile engageable by the running tool; and
   - wherein the cap assembly is installable by engaging the actuator plate assembly to move and land the cap assembly into the equipment and then moving the actuator plate assembly relative to the main body portion to lock the cap assembly inside the equipment.

2. The system of claim 1, wherein the subsea equipment can be a vertical tree, a horizontal tree, a wellhead, or a tubing head spool.

3. The system of claim 2, wherein the main body further includes seals for engaging the vertical tree or the horizontal tree to seal and isolate a main bore from the annulus bore.

4. The system of claim 3, wherein the hot stab receptacle is engageable by a debris cap assembly.

5. The system of claim 2, wherein the main body portion includes a seal that seals the annulus bore in a tree, which is the primary seal barrier for the annulus bore and secondary or tertiary seal barrier for a main bore of the tree.

6. The system of claim 1, further including:
   - a split lock ring assembled to the main body;
   - a seal around the main body; and
   - the main body further including:
     - an elongated stab sub extending from the main body portion into a main bore; and a hot stab receptacle allowing fluid communication with the main bore and the annulus bore.

7. The system of claim 6, wherein the main body further includes more than one valve, wherein the valves are operable to control fluid communication between the hot stab receptacle and the main or annulus bores.

8. The system of claim 6, wherein the elongated stab sub includes a seal that seals the cap assembly to the main bore and isolates the main bore from the annulus bore.

9. The system of claim 6, wherein the split lock ring is actuatable by moving the actuator plate relative to the main body portion.

10. The system of claim 1, wherein the cap assembly is installable in any rotational orientation relative to the subsea equipment.

11. A cap system for subsea equipment comprising a production bore and an annulus bore, the cap system comprising:

a cap assembly including a hot stab receptacle allowing fluid communication with the subsea equipment and a valve operable to control fluid communication between the hot stab receptacle and the production bore or the annulus bore in the subsea equipment;

a debris cap assembly including a hot stab engageable with the hot stab receptacle for establishing fluid communication with the cap assembly; and wherein the hot stab and the hot stab receptacle are configured to enable fluid communication therethrough only when engaged with each other.

12. The system of claim 11, wherein the cap assembly is installable using a running tool either through a riser or open water and comprises:

a main body portion;

an actuator plate assembly movable relative to the main body and comprising a profile engageable by the running tool; and the cap assembly is installable by engaging the actuator plate to move and land the main body portion into the subsea equipment and moving the actuator plate relative to the main body portion to lock the cap assembly inside the subsea equipment.

13. The system of claim 11, wherein the the cap assembly includes a first valve operable to control fluid communication between the hot stab receptacle and the production bore in the subsea equipment and a second valve operable to control fluid communication between the hot stab receptacle and the annulus bore in the subsea equipment.

14. The system of claim 13, wherein the debris cap assembly further includes:

a debris cap body;

a valve paddle manipulator engageable with one of the valves;

a ROV paddle engageable with the valve paddle manipulator;

a ROV hot stab male insert profile; and a ROV hot stab receptacle.

15. The system of claim 14, wherein the valve paddle manipulator controls fluid communication through one of the valves.

16. The system of claim 15, wherein the debris cap assembly includes:

multiple valve paddle manipulators, each engageable with a valve; and multiple ROV paddles, each engageable with a valve paddle manipulator.

17. The system of claim 15, wherein the ROV hot stab receptacle on the debris cap assembly and the hot stab receptacle on the cap assembly are in fluid communication with a main bore and an annulus bore of the subsea equipment.

18. The system of claim 17, wherein fluid may be injected into either to the main or the annulus bore of the subsea equipment via the ROV hot stab without the removal of debris cap assembly.

19. The system of claim 18, wherein the fluid is a chemical.

20. The system of claim 17, wherein fluid may be bled from a production or an annulus bore in the subsea equipment through the ROV hot stab.

21. The system of claim 17, wherein pressure applied above the cap assembly can be balanced below the cap assembly for easy installation and uninstallation.

* * * * *